US009145701B2

(12) United States Patent
Satoh et al.

(10) Patent No.: US 9,145,701 B2
(45) Date of Patent: Sep. 29, 2015

(54) EARTHQUAKE RESISTANT REINFORCEMENT APPARATUS, EARTHQUAKE RESISTANT BUILDING, AND AN EARTHQUAKE RESISTANT REINFORCING METHOD

(71) Applicants: SATOH CO., LTD., Kunitachi-shi, Tokyo (JP); DOMUS ARCHITECT OFFICE CO., LTD., Musashino-shi, Tokyo (JP)

(72) Inventors: Shuichi Satoh, Kunitachi (JP); Isao Okawa, Akishima (JP)

(73) Assignees: SATOH CO., LTD., Tokyo (JP); DOMUS ARCHITECT OFFICE CO., LTD., Tokyo (JP)

( * ) Notice: Subject to any disclaimer, the term of this patent is extended or adjusted under 35 U.S.C. 154(b) by 0 days.

(21) Appl. No.: 14/269,498

(22) Filed: May 5, 2014

(65) Prior Publication Data

US 2015/0033641 A1 Feb. 5, 2015

(30) Foreign Application Priority Data

Jul. 30, 2013 (JP) ..... 2013-157441

(51) Int. Cl.
*E04H 9/02* (2006.01)

(52) U.S. Cl.
CPC ..... *E04H 9/02* (2013.01)

(58) Field of Classification Search
CPC ..... E04H 9/02; E04H 9/021; E04H 9/024; E04H 9/027
USPC ..... 52/167.1, 167.3, 167.4, 167.7, 167.8
See application file for complete search history.

(56) References Cited

U.S. PATENT DOCUMENTS

| | | | | |
|---|---|---|---|---|
| 5,845,438 | A * | 12/1998 | Haskell | 52/167.1 |
| 6,840,017 | B1 * | 1/2005 | Shimoda et al. | 52/167.1 |
| 7,367,075 | B2 * | 5/2008 | Kim | 14/73.5 |
| 2005/0050810 | A1 * | 3/2005 | Shimazaki et al. | 52/167.1 |

FOREIGN PATENT DOCUMENTS

| | | | |
|---|---|---|---|
| JP | 09235890 | A | 9/1997 |
| JP | 2000345718 | A | 12/2000 |
| JP | 2009-275473 | A1 | 11/2009 |
| JP | 2013-19233 | A1 | 1/2013 |

OTHER PUBLICATIONS

Japanese Office Action with English translation dated Sep. 8, 2009 for Japanese Patent Application No. 2004-274177.

* cited by examiner

*Primary Examiner* — Mark Wendell
(74) *Attorney, Agent, or Firm* — Kratz, Quintos & Hanson, LLP

(57) ABSTRACT

An earthquake resistant reinforcement apparatus of a structure that can be attached simply and conveniently even to an aged building and imposes no substantial burden on inhabitants. The structure has an anti-seismic device for absorbing a seismic energy, an attaching member for attaching the anti-seismic device to the outside of a building, and a horizontal supporting member for supporting the anti-seismic device substantially horizontally. A plurality of attaching members are provided spot-wise to the girder or the beam of an existent building and the horizontal supporting member is a horizontal connection beam for connecting the attaching member horizontally.

6 Claims, 8 Drawing Sheets

EARTHQUAKE RESISTANT REINFORCEMENT APPARATUS, EARTHQUAKE RESISTANT BUILDING, AND AN EARTHQUAKE RESISTANT REINFORCING METHOD

CROSS-REFERENCE TO RELATED APPLICATIONS

The disclosure of Japanese Patent Application No. 2013- filed on Jul. 30, 2013 including the specification, drawings, and abstract is incorporated herein by reference in its entirety.

BACKGROUND OF THE INVENTION

1. Field of the Invention

The present invention relates to earthquake resistant reinforcement of a building having a frame structure and it particularly relates to an earthquake resistant reinforcement for a building of relatively low story.

2. Description of the Related Art

Japan geographically situates in earthquake prone areas and frequently suffered from disastrous earthquakes historically in various districts of the country. Particularly, it has been said that the present age is going to enter the period of crustal movement and the possibility of seismic disaster has been increased.

Number of existent buildings in Japan amounts to 23,000,000 or more including many residential buildings not addressing to earthquake resistance or those aged residences likely to suffer from damages.

Further, most of such residences have wooden framework structures, and are not sufficient for earthquake resistance and, accordingly, require earthquake resistant reinforcement.

However, actual progress of adopting the earthquake resistant reinforcement is very slow and, while there are 15,000,000 or more residences requiring such earthquake resistant reinforcement in Japan, countermeasures therefor have not been advanced at present.

SUMMARY OF THE INVENTION

In view of the situations described above, several techniques have been developed for promoting adoption of the earthquake resistant reinforcement.

For example, JP-A No. 2010-275473 provides an anti-seismic device having an anti-seismic element of a specified shape. The device can absorb a seismic force acting on the structural frame of a building by plastic bending deformation of the anti-seismic element, thereby preventing deformation of the building and providing earthquake resistant reinforcement.

However, installation of the anti-seismic device to existent building requires relatively large-scaled construction work, for example, partial detachment of ceiling or floor to give a significant burden on inhabitants.

Further, for avoiding the large-scaled renovation as described above, a technique as disclosed in JP-A No. 2013-19233 is also proposed. This is a technique of performing earthquake resistant reinforcement by simple and convenient construction work of merely removing existent outer walls from below the ceiling to above the floor and installing an earthquake resistant wall. However, even such a simple and convenient construction work imposes a large burden on aged buildings to bring about a problem that there is a limit of ensuring qualified earthquake resistant strength.

The present invention has been accomplished in view of the problems described above and intends to provide an earthquake resistant reinforcement apparatus of high earthquake resistant strength, which can be attached simply and conveniently without imposing significant burdens on inhabitants even to buildings constructed before the year of 1980 in which the new revised earthquake resistant standards were established, since an earthquake resistant wall plane is attached newly by way of a horizontal connection beam that also serves as an attaching member for an earthquake resistant wall from the outside of the building.

For solving the problems described above, the present invention provides an earthquake resistant reinforcement apparatus of a structure comprising an anti-seismic device for absorbing a seismic energy, an attaching member for attaching the anti-seismic device to the outside of a building, and a horizontal supporting member for supporting the anti-seismic device substantially horizontally.

Further, for solving the problem described above, the present invention provides an earthquake resistant building comprising an anti-seismic device for absorbing a seismic energy, an attaching member for attaching the anti-seismic device to the outside of the building, and a horizontal supporting member for supporting the anti-seismic device substantially horizontally.

Further, for solving the problem described above, the present invention provides a method of reinforcing earthquake resistance by using an earthquake resistant reinforcing apparatus of a structure including an anti-seismic device for absorbing a seismic energy, an attaching member for attaching the anti-seismic device to the outside of a building, and a horizontal supporting member for supporting the anti-seismic device substantially horizontally, in which the method includes:

forming a recess for attaching the attaching member to the outer wall of the building, attaching the attaching member to a portion where the recess is formed for attaching the attaching member, and supporting the attaching member to a portion exposed through the recess, and supporting the anti-seismic device by the attaching member and the horizontal supporting member.

Since the externally attached earthquake resistant wall plane of the invention can be simply attached by a required number in parallel with the wall surface of an existent building that requires reinforcement outer wall surface at a some clearance from the outer wall, this provides an advantage capable of economizing the space for installation.

According to the present invention, earthquake resistant reinforcement of the building can be performed simply and conveniently simultaneously with strength reinforcement of an existent building. Further, according to the invention, since the earthquake reinforcement can be provided by attachment of a bearing bracket and a horizontal connection beam and the earthquake resistant wall plane only by the construction work from the out side, significant burden on the inhabitants can be avoided.

Specifically, the externally added earthquake resistant wall structure of the invention has the following advantages.

(1) An earthquake resistant reinforcement structure that can be applied both to wooden and steel structures irrespective of the kind of the structure of existent buildings.

(2) The earthquake resistant bracket and the earthquake resistant wall plane can be attached from the outside of the outer wall by one side work without demolition of the existent building, and it needs no large place for installation.

(3) As to be described later, installation is extremely simple and convenient to mitigate inhabitants' troubles.

(4) Since the earthquake resistant wall plane is installed by way of a bearing bracket directly on one side to a girder of an existent building, a seismic force is absorbed directly and high performance can be expected.

(5) The earthquake resistant reinforcement structure has no temperature dependence and the performance does not change also at the outdoor.

(6) This has a tough structure capable of withstanding repetitive after-shocks.

(7) The reinforcement structure is made of inexpensive metal materials of a simple structure and has improved workability. Further, since the construction work can be simplified further compared with the existent techniques, earthquake resistant reinforcement can be provided with no large-scaled construction work even for aged buildings.

DESCRIPTION OF THE ACCOMPANYING DRAWINGS

DETAILED DESCRIPTION OF PREFERRED EMBODIMENTS

The present invention provides an earthquake resistant reinforcing apparatus of a structure that can be attached also to buildings constructed before enforcement of the new earthquake resistance standards and imposes no significant burden on inhabitants. The invention is to be described with reference to the drawings.

Preferred Embodiments

Figure 1:
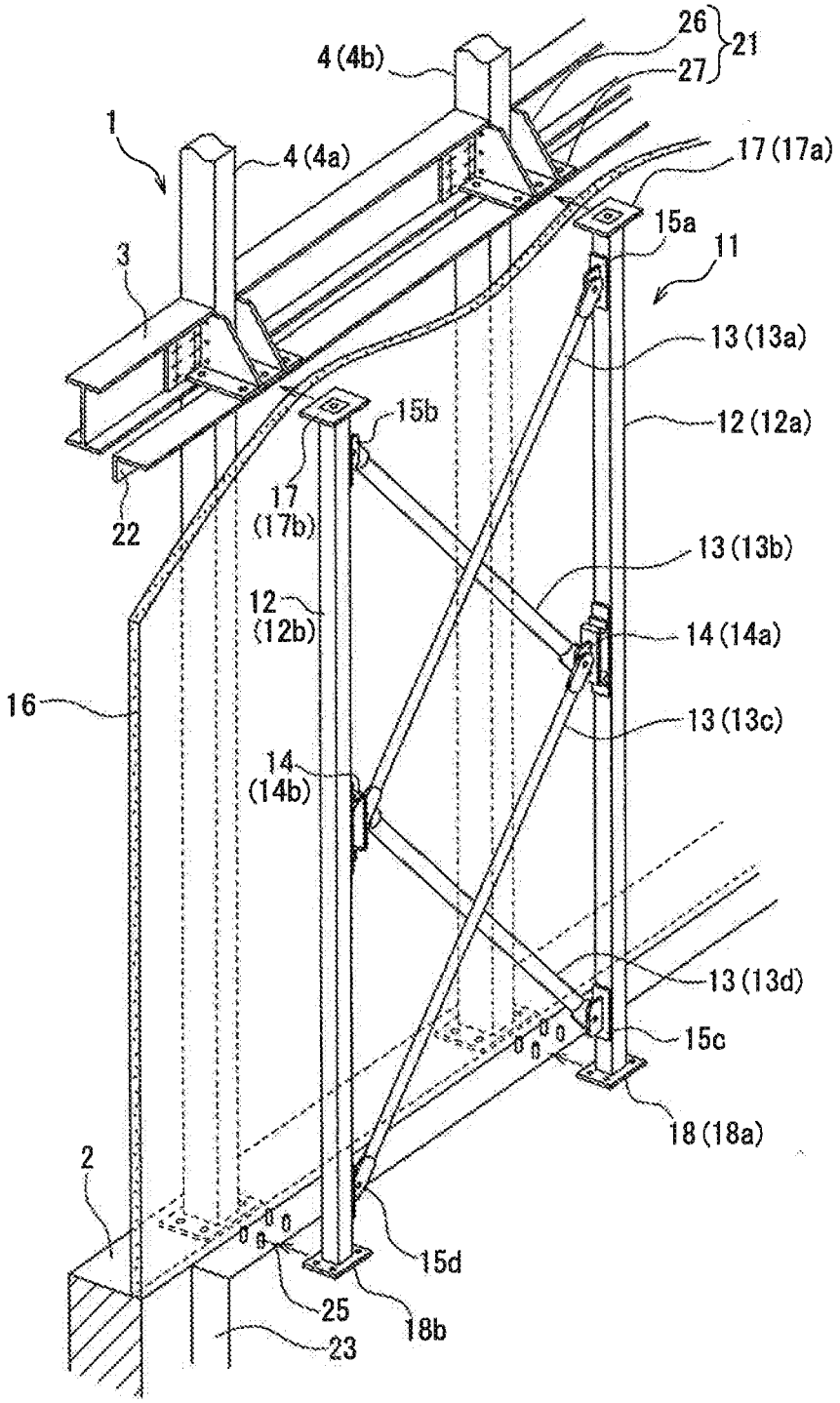
FIG. 1 is a perspective schematic view illustrating a first embodiment.

FIG. 1 is a perspective view illustrating the outline of an earthquake resistant reinforcing structure of the present invention.

According to the invention, an earthquake resistant wall plane 11 (earthquake resistant wall plane 11 as an anti-seismic device) having an anti-seismic function is attached to the outside of an outer wall of an existent building 1, thereby providing earthquake resistant reinforcement to the existent building.

The present invention can provide earthquake resistant reinforcement both to buildings of a wooden structure and buildings of a steel structure (non-wooden structure), and description is to be made herein with reference to an example of a building having the steel structure. Further, the invention provides a structure that can be utilized also for earthquake resistant reinforcement of a new building. Since the invention intends to reinforce mainly the existent building, the following description is to be made to an embodiment of the existent building. "Building" includes herein not only existent buildings but sometimes also buildings to be built newly. Further, in the present specification, "earthquake resistant wall plane" is an abbreviation of "bearing and earthquake resistant wall plane" and it may also include, without restriction, a bearing wall plane not accompanied by the anti-seismic function.

The existent building 1 comprises a footing 2, a girder 3, and main columns 4 (main column 4*a* and mail column 4*b*) of the building 1. The structure of the existent building 1 (girder 3 and main column 4) may be made of a wooden material or a non-wooden material (such as a steel frame)

The earthquake resistant wall plane 11 comprises support columns 12 (support column 12*a* and support column 12*b*), and steel pipe braces 13 (steel pipe brace 13*a* to steel pipe brace 13*d*) as connection members.

The support column 12*a* has a fixing metal 15*a* at an upper stage of an inner lateral side, a fixing metal 15*c* at a lower stage of the inner lateral side, and an anti-seismic element 14*a* at a middle stage of the inner lateral side.

The support column 12*b* has a fixing metal 15*b* at the upper stage of the inner lateral side, a fixing metal 15*d* at the lower stage of the inner lateral side, and an anti-seismic element 14*b* at the middle stage of the inner lateral surface.

Figure 2A:
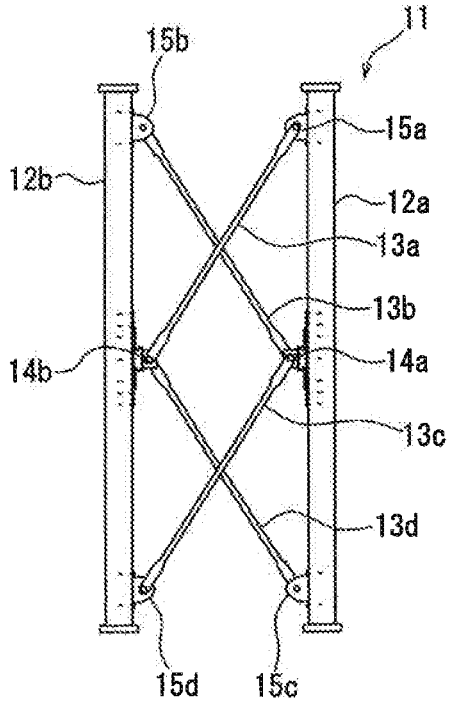
FIG. 2A and FIG. 2B are a view illustrating an earthquake resistant wall plane and an anti-seismic device.
Figure 2B:
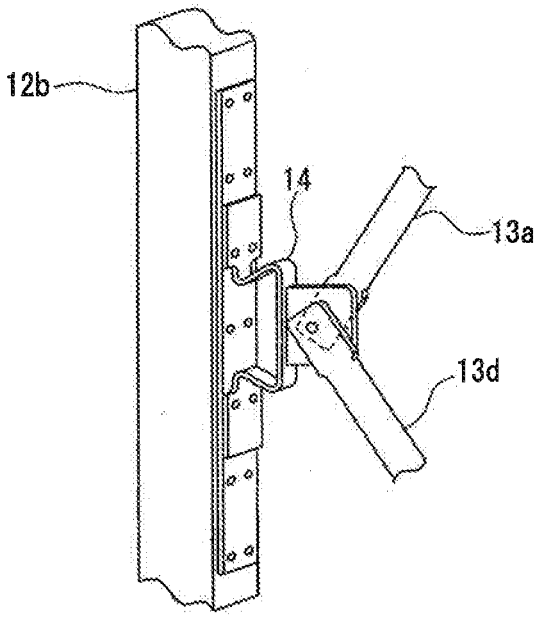

The anti-seismic element 14 is an element of a substantially Ω-shaped configuration (FIG. 2A and FIG. 2B) described, for example, in JP-A 2009-275473 which absorbs a seismic force that may act on the building by plastic bending deformation of the anti-seismic element. In a bearing wall plane having no anti-seismic function, a fixing metal of the same type is applied instead of the anti-seismic element.

The support column 12*a* and the support column 12*b* are connected by two upper and lower pairs of steel pipe braces 13, each pair crossing diagonally. That is, an upper end of the steel pipe brace 13*a* is fixed to the fixing metal 15*a* and the lower end of the steel pipe brace 13*b* is fixed to the anti-seismic element 14*b*. Further, the upper end of the steel pipe brace 13*b* is fixed to the fixing metal 15*b* and the lower end of the steel pipe brace 13*b* is fixed to the anti-seismic element 14*a*. Further, the upper end of the steel pipe brace 13*c* is fixed to the anti-seismic element 14*a* and the lower end of the steel pipe brace 13*c* is fixed to the fixing metal 15*d*. Further, the upper end of the steel pipe brace 13*d* is fixed to the anti-seismic element 14*b* and the lower end of the steel pipe brace 13*d* is fixed to the fixing metal 15*c*. Thus, the support column 12*a* and the support column 12*b* are connected firmly by using a high tension bolt to thereby constitute an earthquake resistant wall plane 11.

The outer wall 16 of the existent building 1 is made of various kinds of materials and has various configurations and sizes. The earthquake resistant wall plane 11 constituted as described above is provided at a some clearance relative to the outside of the outer wall (to be described specifically later).

A column head 17 of the earthquake resistant wall plane 11 is supported by an earthquake resistant bracket 21 as an attaching member and a horizontal connection beam 22 as a horizontal supporting element, and a column leg 18 of the earthquake resistant wall plane 11 is supported by a reinforcing footing 23 and attached to the existent building 1.

At first, a method of fixing the column head 17 is to be described. For fixing the column head 17, the outer wall 16 is recessed for a necessary range at each portion to which the bearing bracket 21 is attached, to thereby expose the girder of the building as an existent structure, and an upper end disposing member is disposed on the lateral side of the girder 3. In the upper end disposing member, the bearing bracket 21 is screw-fixed to the girder 3 on one side, and then a horizontal connection beam 22 is horizontally disposed along the girder 3 to the top end of the arm of the bearing bracket 21.

The bearing bracket 21 has a rectangular bottom plate 27 and two opposing trigonal arm plates 26. A connection hole is formed at a cross section of the arm plate 26 on the side of the girder 3 and the two arm plates 26 are tightly connected by bolts and nuts or one-sided bolts such that the two arm plates 26 put the main column 12 between them. Further, the bottom of the arm plate 26 and the upper surface of the bottom plate 27 are welded. Further, the connection hole is formed in the bottom plate 27 for connection with the horizontal connection beam 22.

The horizontal connection beam 22 is made of an L-shaped steel material and attached to the bearing bracket 21 such that the cross section is downwarded. The kind of the steel material, the direction of the cross section for attachment, and the length of the steel material can be selected optionally. Connection holes are formed each at a predetermined position of the horizontal connection beam 22, and the horizontal connection beam 22 and a plurality of bearing brackets 21 are connected by inserting known connection members (for example, bolts) through the connection holes. A member for disposing the column top of the support column 12 is provided as described above.

Then, a method of fixing a column leg 18 is to be described. For fixing the column leg 18, a column leg disposing member such as a reinforcing footing 23 formed by subsequently piling concrete along an existent continuous footing 2 is used, for example, in a wet construction method. The reinforcing footing is provided so as to extend partially or entirely along the continuous footing 2 of the existent building. Anchor bolts 25 for fixing the column legs are provided to predetermined positions at the upper surface of the reinforcing footing 23, and the column legs 18 are fixed by the anchor bolts 25.

Figure 3A:
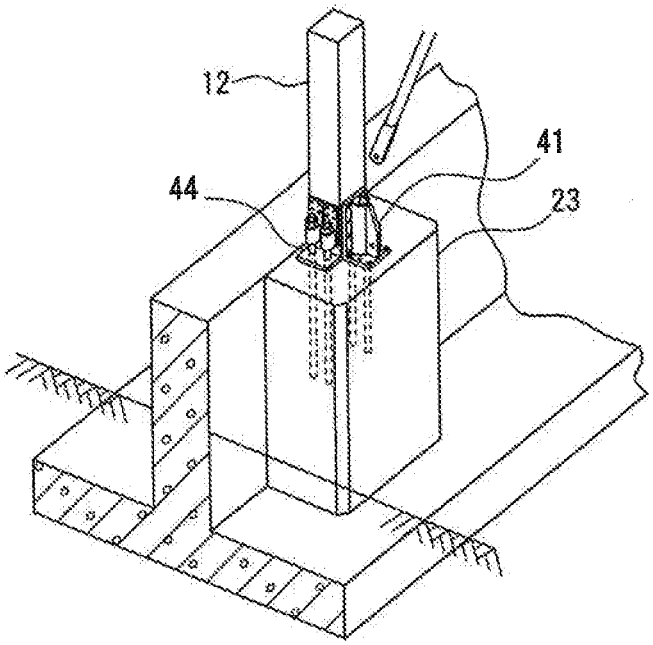
FIG. 3A and FIG. 3B are a view illustrating a lower portion of an earthquake resistant wall plane.

Each of the column legs 13 of the support columns 12 is fixed in a wet construction method, as illustrated in FIG. 3A, by using an anchor bolt 44 buried in a reinforced concrete footing (reinforcing footing 23) formed by piling concrete along the existent continuous footing (footing 2) and a hold down metal 41 welded or screw-fixed to the column leg 13 of the support column 12 together. Thus, the support column 12 is firmly fixed by the footing 2.

Figure 3B:
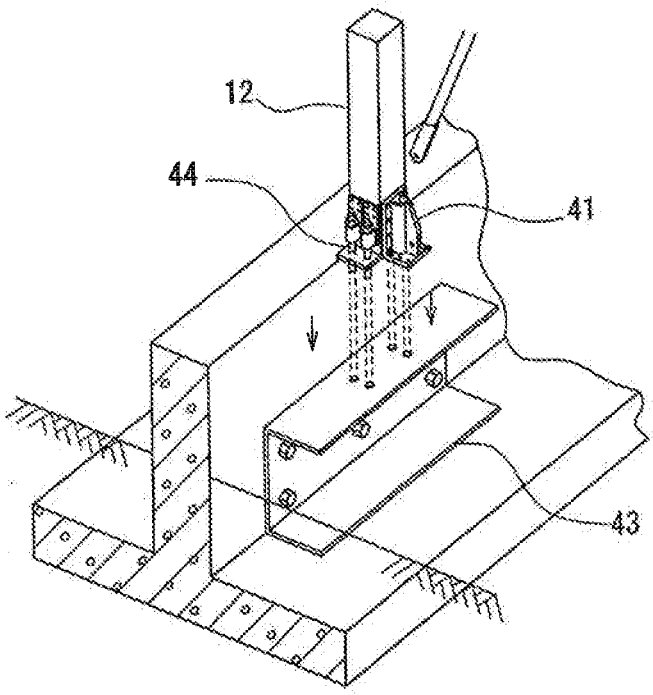

As illustrated in FIG. 3B. The column leg may also be fixed, in a dry construction method, by a hold down metal 41 welded or screw-fixed to the column leg by using a channel member 43 fixed to the lateral side of the footing 2 instead of the reinforcing footing 23.

Figure 4:
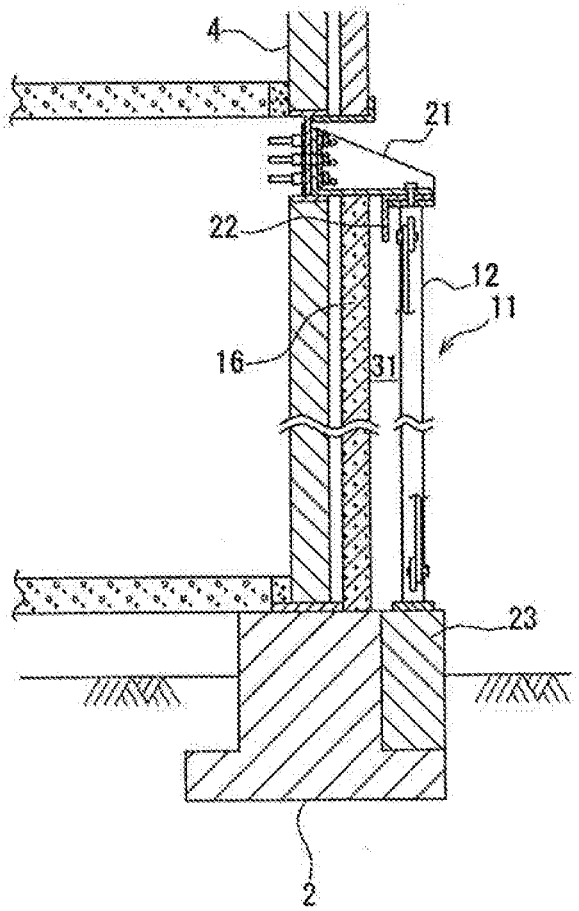
FIG. 4 is a side elevational vertical cross sectional view in a state of attaching the earthquake resistant wall plane to an existent building.

FIG. 4 is a lateral longitudinal cross sectional view of an existent building of a light-gauge steel structure and an earthquake resistant wall plane 11.

The earthquake resistant wall plane 11 is preferably attached such that a some clearance 31 is formed relative to the outer wall 16 of the existent building 1. That is, a clearance of about 100 mm is formed between the center of the support column 12 of the earthquake resistant wall plane 11 and the center of the outer wall 16 of the existent building 1 such that the earthquake resistant wall plane 11 and the existent building 1 are not in contact to each other upon undergoing seismic vibrations. This can prevent interference between the earthquake resistant wall plane 11 and the existent building 1 when earthquake occurs, which may otherwise fracture the attaching portion or damage the outer wall 16. The clearance between them is not restricted to 100 mm but can be selected optionally.

In this embodiment, the bearing bracket 21 is provided to a joint between the main column 12 and the girder 3 (FIG. 1). That is, the bearing bracket 21 is provided not in a continuous stripe configuration along the girder 3 but provided spot-wise at a position where the main column 12 and the girder 3 intersect (corresponding to the point of contact of the horizontal lattice beam).

The bearing bracket 21 is disposed by forming a recess in the outer wall of the existent building 1. If a strip-like continuous recess is formed, some or other bearing defects may be caused to the existent building 1. However, since the bearing brackets 21 are disposed spot-wise, burden on the existent building 1 can be minimized.

Further, since the girder 3 of the existent building and the horizontal connecting beam 22 are integrated to provide earthquake resistant reinforcement more strongly and the seismic force acting on the existent building 1 is reliably transmitted to the earthquake resistant wall plane 11 and minimize the load of the seismic force on the existent building.

Further, when a plurality of the bearing brackets 21 are connected by the horizontal connection beam 22 as illustrated in FIG. 1, the horizontal connection beam 22 serves as a sort of a wind resistant horizontal beam. Accordingly, they can endure the horizontal seismic force acting on the existent building 1 in cooperation with the girder 3 for the outer wall of the existent building 1 and can transmit the acting force with scarce loss to the externally attached earthquake resistant wall plane 11. This effect cannot be provided sufficiently only by using the bearing brackets 21 but can be provided sufficiently only when the bearing bracket 21 is combined with the horizontal connected beam 22. The length of the horizontal connection beam 22 is increased or decreased depending on the scale of the existent building 1 or the number of the earthquake resistant wall planes 11, thereby capable of shortening the time for the construction work and reducing the construction cost. Further, provision of the horizontal connection beam 22 can reinforce the building itself.

Figure 5:
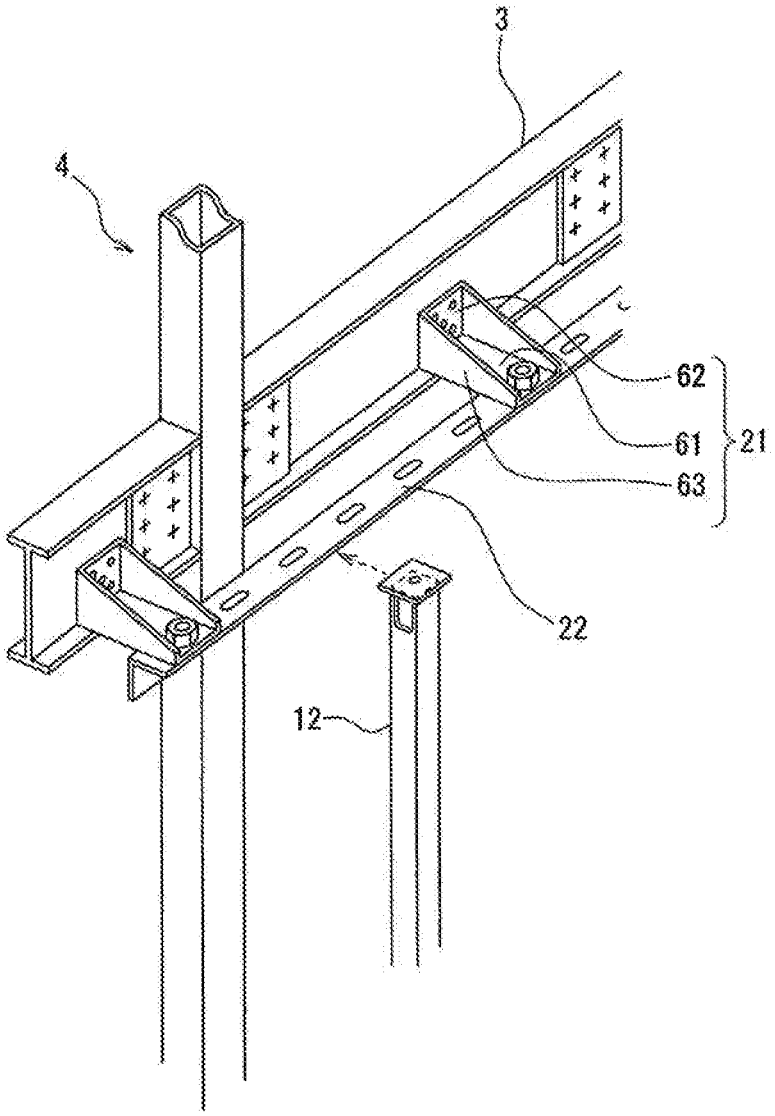
FIG. 5 is a perspective schematic view illustrating a second embodiment.

FIG. 5 illustrates another embodiment of the earthquake resistant structure according to the invention. A bearing bracket 21 comprises a rectangular bottom plate 61, a rectangular back plate 62, and two opposing trigonal arm plates 63.

The arm plate 63 and the back plate 62 are bent into a U-shaped configuration and welded to the bottom plate 61. Connection holes for connection with the existent building 1 and the girder 3 are formed in the bottom plate 62.

When the bearing bracket 21 is attached to the girder 3 of the existent building 1, the bearing bracket 21 is tightly joined to the web of the girder 3 from the outside by a one-sided bolt irrespective of the position of the main column 4 of the existent building 1.

Further, connection holes are formed in the bottom plate 61 for tightly connecting the lower flange of the girder 3 and the horizontal connection beam 22.

This embodiment is extremely effective since the externally added earthquake resistant plane 11 can be installed to an optional position of the existent building 1 (outer wall 16).

Figure 6:
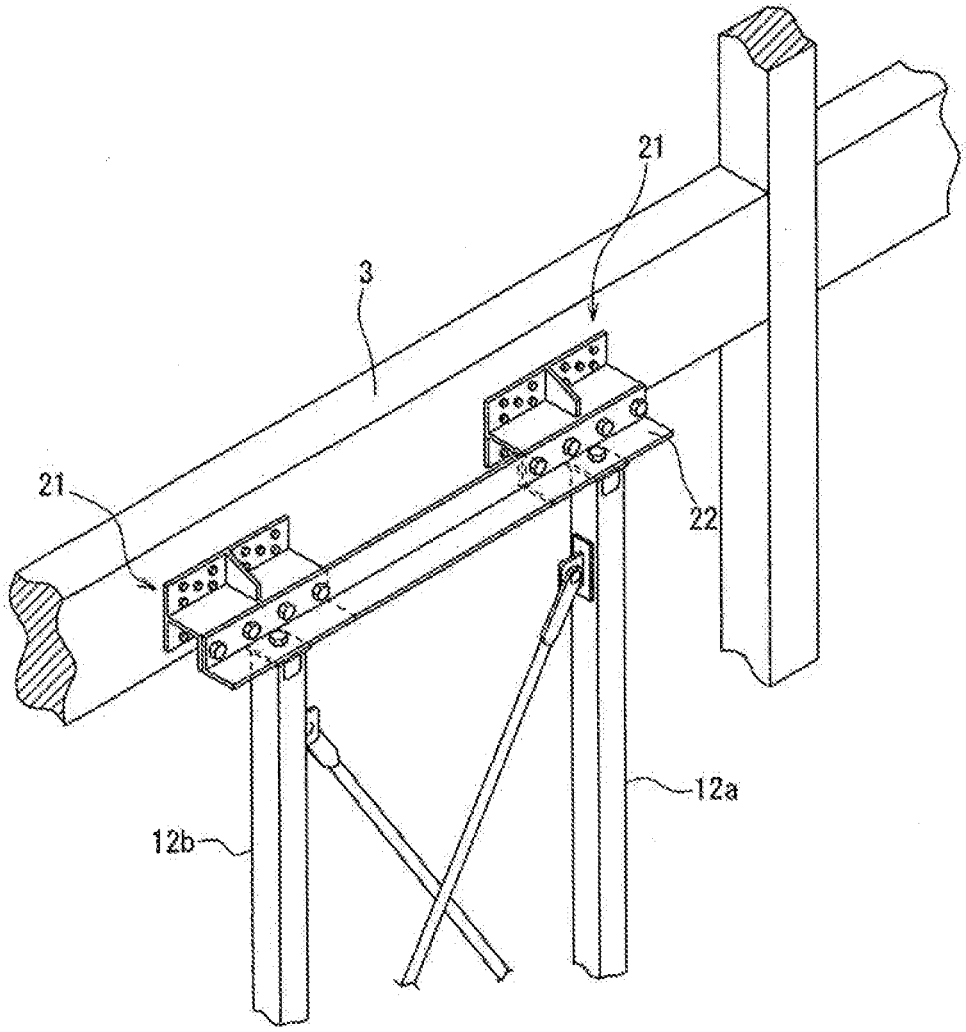
FIG. 6 is an upper perspective schematic view of a wooden framework structure illustrating a third embodiment.
Figure 7:
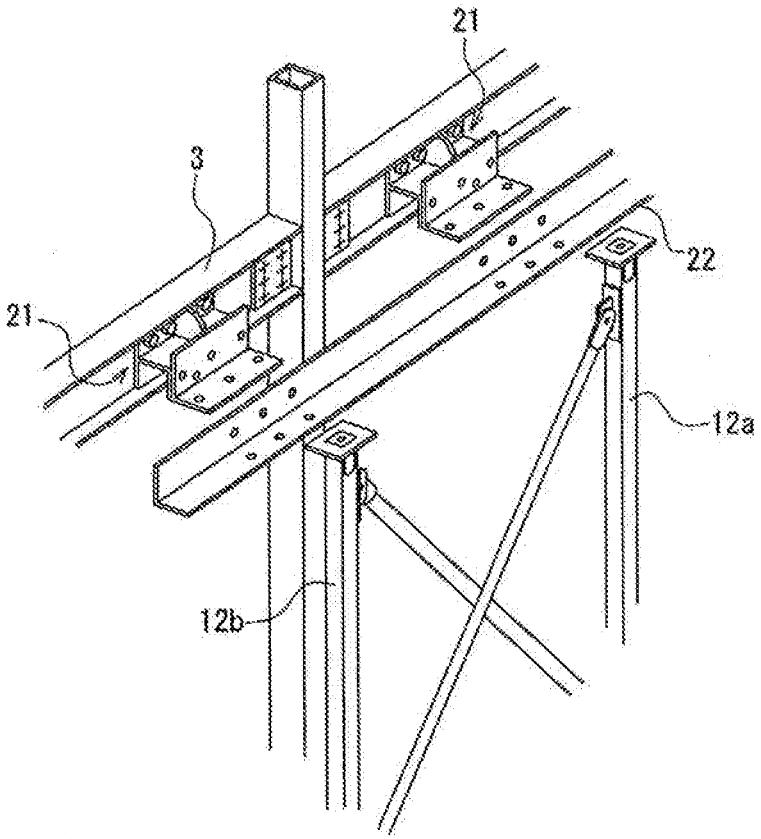
FIG. 7 is an upper perspective schematic view of a steel structure illustrating a fourth embodiment.

FIG. 6 and FIG. 7 illustrate other embodiments of the earthquake resistant structure according to the invention in which FIG. 6 illustrates an embodiment of attaching a bearing bracket 21 to an existent building of a wooden frame structure and FIG. 7 shows an embodiment of attaching a bearing bracket 21 to an existent building of a steel structure.

Figure 8:
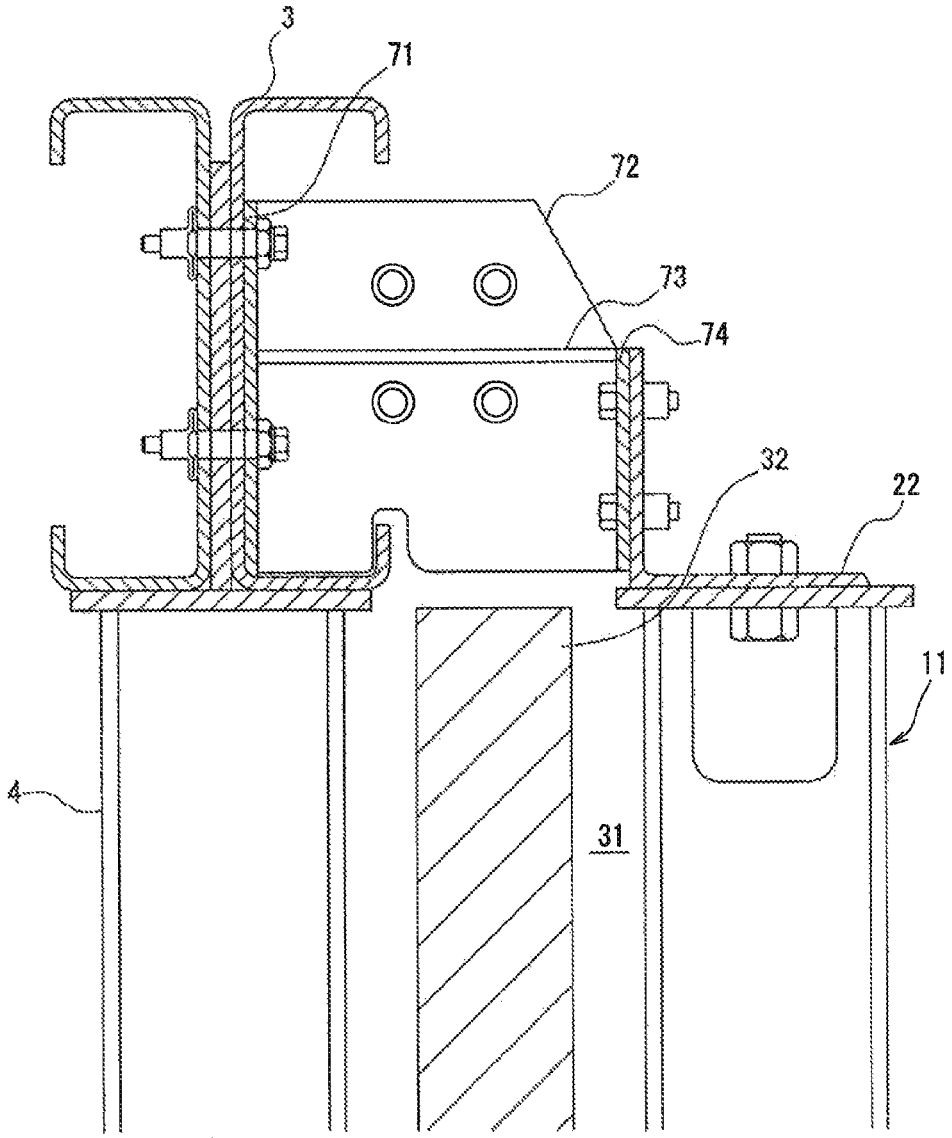
FIG. 8 is a view illustrating a connection structure for an upper portion of the earthquake resistant wall plane.

FIG. 8 illustrates the bearing bracket 21 of FIG. 6 and FIG. 7 in details. As illustrated in FIG. 8, the bearing bracket 21 comprises a rectangular back plate 71 for attachment to the lateral side facing the outside of the girder 3 of the existent building 1, a substantially trigonal arm plate 72 (arm) attached vertically to the central portion thereof, and a horizontal vibration stop plate 73 for horizontally connecting the back plate 71 and the arm plate 72 (horizontal vibration stop member for preventing the arm plate 72 from vibrating in the horizontal direction), and an angle 74 for attaching a horizontal connection beam 22 is welded to the outside of the horizontal vibration stop plate 73. By mounting the bearing bracket 21 and the horizontal connection beam 22 of the structure described above to an existent wooden building 1, a horizontal seismic force can be transmitted reliably to the externally added earthquake resistant wall plane 11. Further, provision of the horizontal vibration stop plate 73 can decrease the number of the bearing brackets 21 to be installed.

Then, a method of attaching the bearing bracket 21 to the existent building 1 is to be described.

At first, for attaching the bearing bracket 21, a plurality of recesses are formed spot-wise to the outer wall of the existent building 1. The recesses are formed only to the portions of attaching the bearing brackets 21 and each of the recesses is cut out to a size substantially equal with that of the back surface (attaching portion) of the bearing bracket 21. By minimizing the recessed portion, bearing deficiency of the existent building 1 can be minimized.

What is claimed is:

1. An earthquake resistant reinforcement apparatus of a structure comprising:

an anti-seismic device for absorbing a seismic energy, an attaching member that attaches to the anti-seismic device and to the outside of a building, and a horizontal supporting member for supporting the anti-seismic device substantially horizontally, the horizontal supporting member being horizontal in its entirety, a plurality of the attaching member being disposed spot-wise in plurality to a girder of the building or the outer wall of the building, the horizontal supporting member being a rigid horizontal connection member connecting the attaching member horizontally, and the anti-seismic device being disposed so as to provide a predetermined space relative to the outer wall of the building, wherein the horizontal supporting member is connected to the attaching member and works with the attaching member to transmit the seismic energy exerted on the building to the anti-seismic device with little loss.

2. The earthquake reinforcing structure according claim 1, wherein the attaching member has a horizontal vibration stopping member for preventing the arm of the attaching member from vibrating in the horizontal direction.

3. An earthquake resistant building including:

an anti-seismic device for absorbing a seismic energy, an attaching member that attaches to the anti-seismic device and to the outside of the building, a horizontal supporting member for supporting the anti-seismic device substantially horizontally, the horizontal supporting member being horizontal in its entirety, a plurality of the attaching member being disposed spot-wise in plurality to a girder of the building or the outer wall of the building, the horizontal supporting member being a rigid horizontal connection beam connecting the attaching member horizontally, and the anti-seismic device being disposed so as to provide a predetermined space relative to the outer wall of the building, wherein the horizontal supporting member is connected to the attaching member and works with the attaching member to transmit the seismic energy exerted on the structure to the anti-seismic device with little loss.

4. The earthquake resistant building according claim 3, wherein the attaching member has a horizontal vibration stopping member for preventing the arm of the attaching member from vibrating in the horizontal direction.

5. A method of reinforcing earthquake resistance by using an earthquake resistant reinforcing apparatus of a structure including:

an anti-seismic device for absorbing a seismic energy, an attaching member that attaches to the anti-seismic device and to the outside of a building, a horizontal supporting member for supporting the anti-seismic device substantially horizontally, the horizontal supporting member being horizontal in its entirety, a plurality of the attaching member being disposed spot-wise to a girder of the building or the outer wall of the building, the horizontal supporting member being a rigid horizontal connection beam connecting the attaching member horizontally, and the anti-seismic member being disposed so as to provide a predetermined space relative to the outer wall of the building, wherein the horizontal supporting member is connected to the attaching member and works with the attaching member to transmit the seismic energy exerted on the structure to the anti-seismic device with little loss, in which the method includes:

forming a recess for attaching the attaching member to the outer wall of the building, attaching the attaching member to a portion where the recess is formed for attaching the attaching member, and supporting the attaching member to a portion exposed through the recess, and supporting the anti-seismic device by the attaching member and the horizontal supporting member.

6. The method according claim 5, wherein the attaching member has a horizontal vibration stopping member for preventing the arm of the attaching member from vibrating in the horizontal direction.

* * * * *